United States Patent [19]

Windorski

[11] Patent Number: 4,696,399

[45] Date of Patent: Sep. 29, 1987

[54] NOTEPAPER DISPENSING TRAY

[75] Inventor: David C. Windorski, Cottage Grove, Minn.

[73] Assignee: Minnesota Mining and Manufacturing Company, Saint Paul, Minn.

[21] Appl. No.: 793,481

[22] Filed: Oct. 29, 1985

Related U.S. Application Data

[63] Continuation-in-part of Ser. No. 634,972, Jul. 27, 1984, abandoned.

[51] Int. Cl.[4] ..... B65D 6/04

[52] U.S. Cl. ..... 206/565; 206/215; 206/451; 206/555; 206/560; 211/57.1; 211/59.2; 221/27; 312/50; 312/187

[58] Field of Search ..... 206/449, 451, 214, 215, 206/371, 555, 556, 818, 557, 560, 565; 211/50, 52, 72, 57.1, 11, 59.2, 51; 312/50, 185, 187, 60; 24/67 R, 67.11; D19/75, 78, 92, 96; 221/27

[56] References Cited

U.S. PATENT DOCUMENTS

| | | | |
|---|---|---|---|
| D. 273,798 | 5/1984 | Pearson . | |
| 4,989 | 7/1872 | Amberg | 206/560 X |
| 530,806 | 12/1894 | Tilton | 211/50 X |
| 1,162,003 | 11/1915 | Weldy | 211/51 |
| 1,236,698 | 8/1917 | Gauch | 24/67 R |
| 1,386,700 | 8/1921 | Gilbert | 206/214 X |
| 2,001,774 | 5/1935 | Deli | 211/50 |
| 2,237,532 | 4/1941 | Posnack | 206/565 X |
| 2,462,789 | 2/1949 | Trollen | 206/449 |
| 2,609,219 | 9/1952 | Marano | 206/556 X |
| 2,981,408 | 4/1961 | Gamble | 206/555 |
| 3,195,022 | 7/1965 | Staver | 206/818 X |

OTHER PUBLICATIONS

Catalogue p. 4 by Lasercraft illustrating, "NoteTakers".
Catalogue p. 6 by Lasercraft.
P. 5 from catalogue by Lasercraft re "NoteTakers".

*Primary Examiner*—Stephen Marcus
*Assistant Examiner*—Bryon Gehman
*Attorney, Agent, or Firm*—Donald M. Sell; James A. Smith; John C. Barnes

[57] ABSTRACT

A notepaper dispenser for holding and dispensing sheets singly from a pad of notepaper with the sheets held in the pad by a narrow band of adhesive on one side of each sheet and adjacent one end is disclosed which has a support surface for the pad, a clamp for holding the bottom sheet in an area spaced from the band of adhesive in fixed position in relationship to the support surface and an abutment for engaging an edge of the pad opposite the end of the sheets joined together by the adhesive for restricting peeling forces resulting from peeling the top sheet being transferred to the bottom sheet of the pad.

4 Claims, 10 Drawing Figures

NOTEPAPER DISPENSING TRAY

This application is a continuation-in-part of Ser. No. 634,972, filed July 27, 1984, now abandoned.

BACKGROUND OF THE INVENTION

1 Field of the Invention

The present invention relates to an improvement in a tray for supporting notepaper, and in one aspect to a new configuration of a tray for supporting the stack of notepaper to permit dispensing single sheets from a stack of notepaper without separating the stack from the support.

2 Description of the Prior Art

Notepaper has become commercially available by the assignee of this application, Minnesota Mining and Manufacturing Company, wherein the stack of sheet material comprises a plurality of sheets each of which are coated with a narrow band of readily releasable pressure-sensitive adhesive along one edge and the sheets are stacked with the adhesive coated edge of each sheet positioned above each other adhesive coated edge. The band of adhesive ranges between one-fourth and three-fourths of an inch wide. The individual sheets may be readily withdrawn from the stack by peeling the sheet and its adhesive from the next adjacent sheet in the stack. The adhesive is a readily repositionable pressure-sensitive adhesive such that the separated sheet may be attached to another sheet or other receptor surface and readily removed without tearing the fibers of the other sheet or receptor surface upon later separating the sheet.

A stack of this notepaper is adapted to be supported on a holder such as is disclosed in U.S. Pat. No. Des. 273,798 issued May 8, 1984. This particular prior holder had a surface for supporting the stack of sheet material and relied on the adhesive on the surface of the lower sheet of the stack or on an additional strip of adhesive to secure the stack of sheets or pad to the support surface on the holder. After several uses of the pad holder, it was noted that the surface would become soiled or the strip of adhesive applied to the holder became contaminated such that the pad was not secure enough to the holder to permit separation of one sheet from the stack without the separating force being sufficient to also separate the entire stack from the holder, particularly as the number of sheets in the stack was depleted. Therefore, improvements in holders for dispensing the pressure-sensitive adhesive coated notepapers from a stack became desirable.

The present invention describes an improved notepaper dispenser which affords a support surface for supporting a stack or pad of sheet material and on a surface which permits writing on the notepaper before the same is removed from the stack. Further, the holder of the present invention provides means for holding the bottom sheet in a stack against movement in the plane of the support surface. The holder for the notepaper is provided with abutment means which projects above the plane of the support surface supporting the notepaper to restrict movement of the stack during the separation of the uppermost sheet from the stack and peeling forces from being applied to the band of adhesive on the lowermost sheets.

SUMMARY OF THE INVENTION

The present invention relates to an improvement in notepaper dispensers and particularly to an improvement in holders for pads of notepaper which comprise sheets held together with a narrow band of pressure sensitive adhesive material. The holder permits the sheets to be dispensed individually and holds a stack of sheets such that the forces imparted to the stack during the separation of the individual sheets will not separate the stack from the holder. The holder comprises a frame having a support surface or platen for supporting a stack of sheet material generally in a plane such that the sheets are supported on a generally planar surface and the sheets may be written upon while in the stack. The holder comprises means for holding the lowermost sheet in the stack to restrict movement in the plane of the supporting surface and abutment means are provided to engage an edge of the stack to restrict movement of the stack during the separation of a sheet from the stack. Preferably the abutment is positioned opposite the edges of the sheets which are secured together.

The means which restricts the bottom sheet in the stack against movement in the plane of the support surface may comprise a plate which fits over the lowermost sheet and clamps the sheet to the holder. Such clamping may be afforded by a pivoted platen which frictionally grips the lowermost sheet and may include pins which perforate the lowermost sheet. The clamping action may be afforded by physical forces applied to the lowermost sheet, such as frictional forces applied by weight, by springs, by the use of magnets, or by physically bending the lowermost sheet such that increased forces are needed to release the lowermost sheet from the support surface.

The abutment means may be formed on the frame of the holder or may be formed in the clamping plate. The abutment means projects above the plane of the support platen and engages at least a number of the sheets along the front edge of the stack on an edge opposite the edge where the sheets are adhered together. The abutment means restricts movement of the stack with respect to the support platen including lifting or rotational movement.

DESCRIPTION OF THE DRAWING

The present invention will be described in greater detail with reference to the accompanying drawing wherein.

DESCRIPTION OF THE PREFERRED EMBODIMENTS

Figure 1:
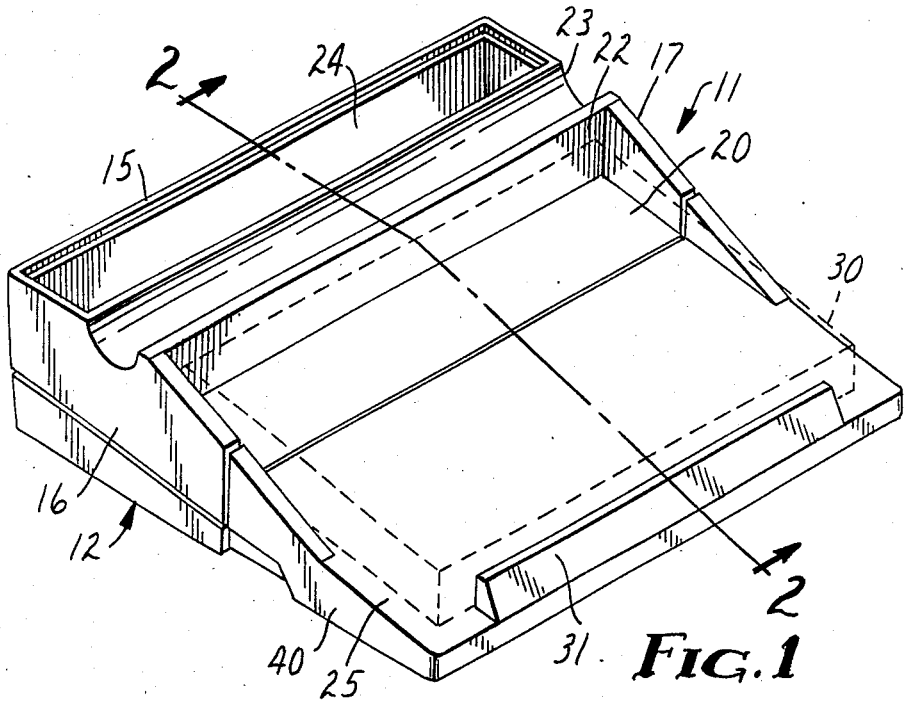
FIG. 1 is a perspective view of a holder according to the present invention.

Referring now to FIG. 1 there is illustrated a dispenser for a stack of notepaper, which dispenser is generally designated by the reference numeral 11 and comprises a main frame 12 which may be molded and formed of joined parts to have an inner cavity 13 which may be filled with a sand or other heavy material to weight the dispenser. The frame 12 has a bottom plate 14, a rear wall 15, opposed side walls 16 and 17, between which extend a generally planar support 20 for a stack of sheet material. The support 20 extends from the front edge 21 of the holder to a generally vertical member 22, which would be at one end of the stack 30 of sheet material and which, at its upper end, connects with the top 23 of the frame 12. The top 23 is shaped to form a cradle for a writing instrument and continues to a well 24 shaped to receive a refill stack of notepaper, paper clips, or the upper surface surrounding the well 24 may support a nameplate, etc.

Figure 2:
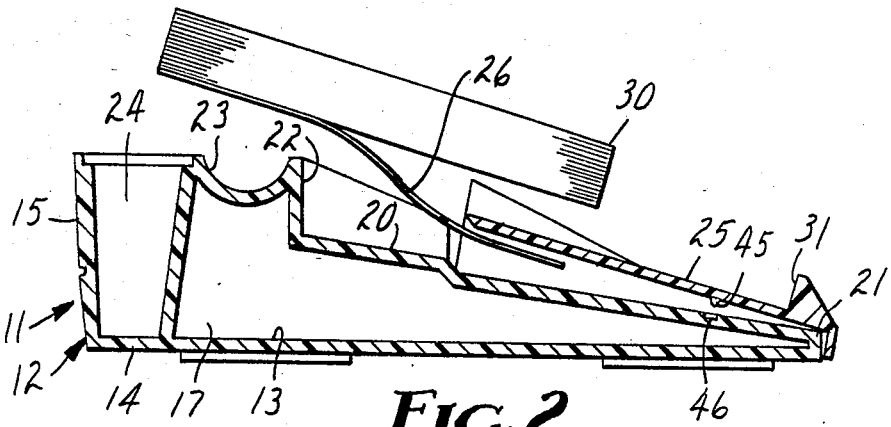
FIG. 2 is a detailed vertical sectional view taken along the lines 2—2 of FIG. 1, showing the clamping portion of the holder in raised position to accept the lowermost sheet of a stack of notepaper.
Figure 3:
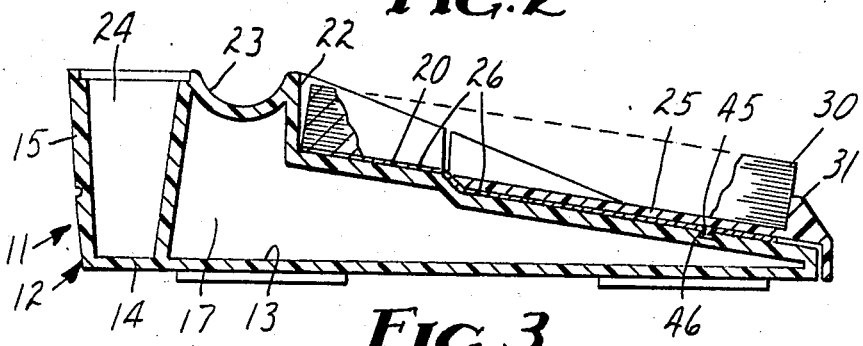
FIG. 3 is a vertical sectional view taken along the lines 2—2 of FIG. 1 showing the stack of notepaper supported on the holder partially in phantom view

Supported for pivotal movement relative to the frame 12 is a platen or planar clamping plate 25 which is adapted for clamping the lowermost sheet 26 of a stack of sheets 30 onto the frame 12 of the holder. As illustrated in FIGS. 1, 2 and 3, the plate 25 is adapted to pivot relative to the frame 12 and cooperates with the support 20 to firmly hold the lowermost sheet 26 in a position between the support 20 and the under side of the plate 25 to restrict movement of the sheet 26 with respect to the plane of the support 20. Extending upwardly from the forward end of the plate 25 is an abutment 31 which engages the edge of the lowermost sheets in the stack. The abutment 31 serves to restrict movement of a stack of sheets with respect to the platen 25 and support 20 during separation of the uppermost sheet in the stack. During the peeling or stripping movement when separating one sheet from the stack 30 the stack tends to lift adjacent the edge where the sheets are joined, driving the stack forward or to apply a rotational or torsional force to be transmitted to the stack. These forces will be absorbed by the abutment and restrict movement of the pad with respect to the support and translates the forces to shear forces on the bands of adhesive joining the sheets to restrict separation of the stack from the lowermost sheet.

FIG. 3 illustrates in sectional view a stack 30 of sheet material on the dispenser 11 with the lowermost sheet 26 clamped between the platen 25 and the support surface 20. The clamp holds the lower sheet at a position adjacent the edge where the sheets are joined together as illustrated. This restricts a lifting and peeling force to be exerted between the lower sheet and the pad.

The pad or stack of sheet material illustrated comprises sheets of notepaper, approximately twenty pound bond paper, with each sheet coated along one edge with a readily repositionable pressure-sensitive adhesive. The adhesive is coated in a band about one-fourth to three-fourths of an inch wide.

Figure 4:
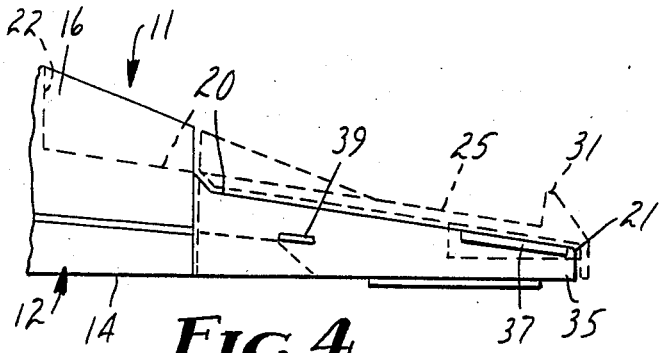
FIG. 4 is a fragmentary detailed side view showing the frame of the holder and the support for the clamping plate with the adjacent edge of the clamping plate in phantom broken lines.
Figure 5:
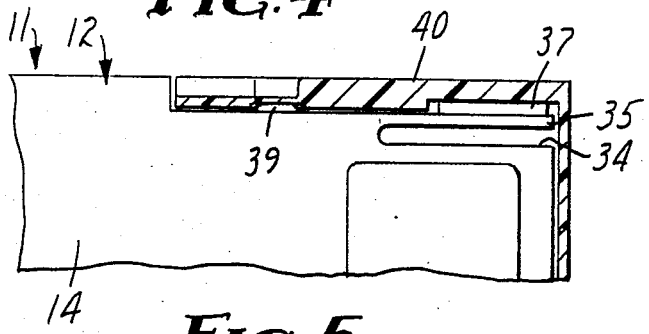
FIG. 5 is a fragmentary detailed bottom view partly in section showing the clamping plate and the frame of the holder.
Figure 6:
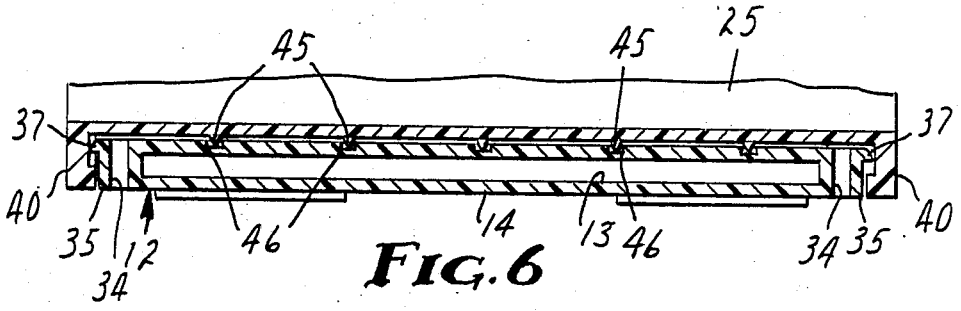
FIG. 6 is a detailed sectional view showing the clamping plate and holder frame with pins to penetrate the bottom sheet of the stack.

FIGS. 4, 5 and 6 illustrate the details of the clamping plate and the support. The main frame 12 is provided at its forward end with a cut-away as illustrated at 34 to leave a narrow resilient finger 35 extending along the lateral edge of the frame 12. Extending outward from the finger 35 is a fulcrum member 37 which defines the fulcrum for the pivoting clamping plate 25. Also extending outwardly from the lateral edge of the frame 12 is a stop member 39 which is spaced from the front edge of the frame 12.

As illustrated in FIGS. 4 and 5, the platen 25 is formed with depending side members 40 which cover the lateral edges of the frame 12 and the cover members 40 are provided with interior recesses cooperating with the fulcrum members 37 and the stop members 39 affording limited pivotal movement of the plate 25 and positioning of the plate 25.

As illustrated in FIGS. 2, 3 and 6, the under surface of the clamping plate 25 may be provided with transversely spaced pointed projections 45 which extend from the under surface of the plate 25 and cooperate with recesses 46 in the support member 20 such that upon insertion of the lowermost sheet 26 in the stack 30 the projections 45 will penetrate the sheet and hold the sheet securely against movement with respect to the support 20.

The clamping plate 25 could also be formed with a resilient detent similar to the stop member 39 which would lock in a cooperating recess to frictionally hold the bottom sheet 26 securely between the support 20 and plate 25.

The dispenser 11 with the pivoted clamping plate 25 locks the lowermost sheet in position and holds the paper in a predetermined plane with respect to the support 20 and the plate 25 such that the user may write on the sheets of notepaper before separation from the stack down to the very last sheet without encountering an uneven writing surface beneath the next to the last sheet in the stack.

Figure 7:
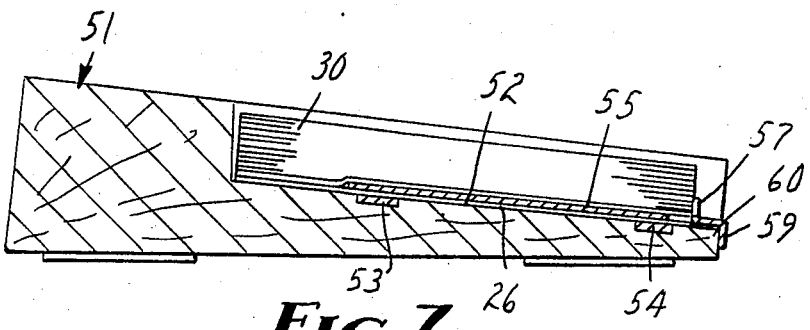
FIG. 7 is a sectional view of a second embodiment of the present invention.

A second embodiment of the invention is illustrated in FIG. 7 which illustrates a dispenser generally designated 51 comprising means defining a frame having means defining a support surface 52. Embedded in the support surface 52 and extending transversely thereof are a pair of permanent magnets 53 and 54 which are bars of a permanent magnetic material. A clamping plate 55 formed of a magnetic material may be inserted between the lowermost sheet 26 of a stack of sheet material and the next adjacent sheet and the magnets 53 and 54 will clamp the sheet against the support 52 with sufficient force to hold the sheet 26 and the stack 30 against movement with respect to the support surface. The magnetic plate 55 is provided with a raised and transversely extending abutment 57 which engages one or more of the sheets in the stack adjacent the front edge of the stack to hold the stack against movement. Also, the end 59 of the plate 55 may be bend downwardly across the width of the plate to position the plate with respect to the front edge 60 of the holder, and position the opposite edge of the plate adjacent the adhesive band of the stack.

Figure 8:
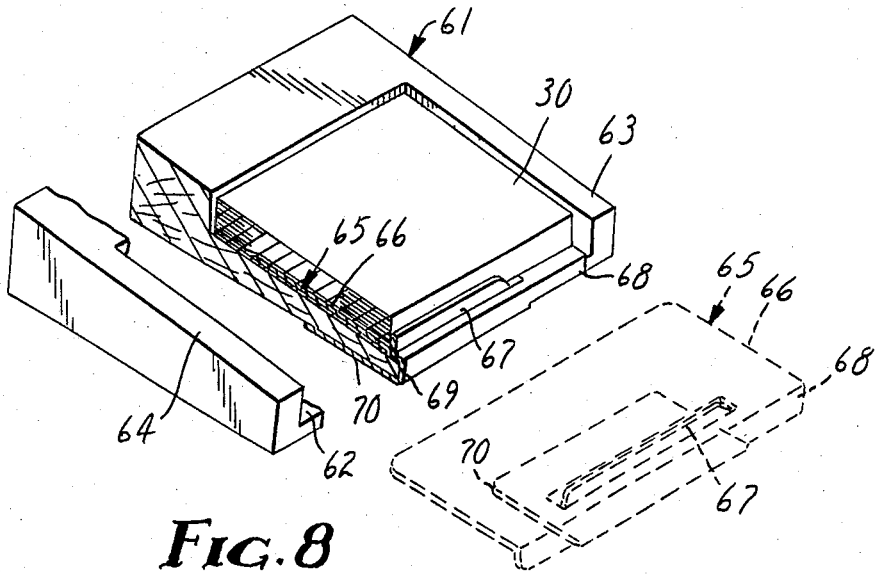
FIG. 8 is a fragmentary perspective view of a further embodiment of the present invention with the figure partly in section and a phantom view of the clamping plate separated from the holder.

In a further embodiment of the invention as illustrated in FIG. 8 the dispenser 61 may have a frame formed of wood, stone, or other solid material and shaped to define a support surface 62. The support surface 62 may be formed on a surface recessed between edges 63 and 64 to afford an improved artistic design for supporting the notepaper. In this embodiment the stack 30 of notepaper is positioned within the recessed area and the lowermost sheet in the stack is clamped between a clamping plate member 65 and the support surface 62 as illustrated in FIG. 8. The clamping plate 65 as shown more clearly in phantom view in FIG. 8 and partially in section generally U-shaped comprises an upper support plate 66 that fits over the lowermost sheet in the stack and forms a support or writing surface for the sheet material. Bent from the surface of the plate 66 and extending upwardly therefrom is an abutment member 67 which engages the front edge of the sheets in the stack 30. The clamping plate 66 has a depending flange portion 68 which has a thickness equal to or slightly greater than the height of the front edge 69 of the holder 61 and has a lower locking plate 70 which fits beneath the holder 61 and the support surface 62 thereof.

In operation, as the clamping plate 67 is inserted over the lowermost sheet and moved rearwardly with respect to the recess in the holder 61, the normal resilience of the material forming the clamping plate 67 pinches or binds and frictionally holds the lowermost sheet of the stack firmly on the support 62. The abutment 67 in the meantime engages the front edge of the stack to restrict any rotational movement of the stack with respect to the support plate 65.

Figure 9:
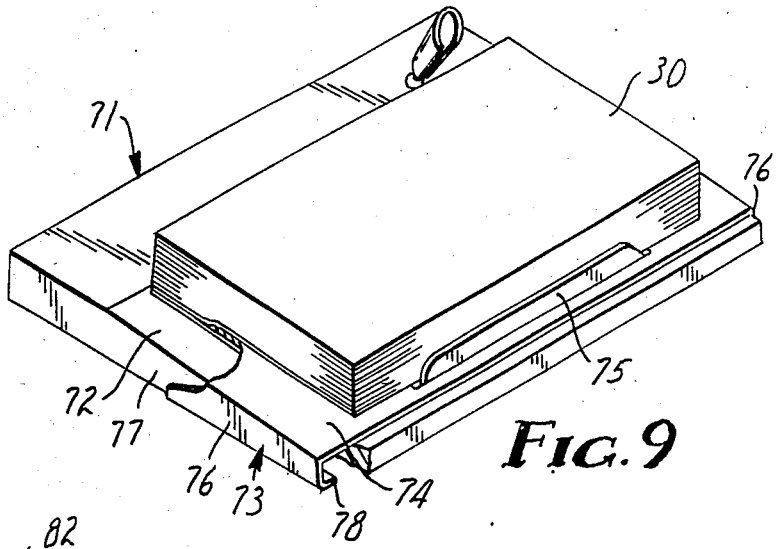
FIG. 9 is a perspective view of a further embodiment showing portions broken away for purposes of illustration.

A similar embodiment for a notepad holder and dispenser is illustrated in FIG. 9. This holder, generally designated 71, formed of a solid material and generally wedge shaped, has an upper support surface 72 for supporting the stack 30 of notepaper. A clamping plate for clamping the lowermost sheet in the stack to the holder 71 and in position on the support surface 72 comprises a clamping member 73 comprising a clamping plate 74 adapted to extend over the lowermost sheet in the stack and to support the stack and clamp the lowermost sheet against the support surface 72. Extending upward from and cut from the plate 74 defining the support platen is a bent flange portion 75 defining an abutment member engaging the stack 30 along the lower front edge of the sheet material.

The plate 74 is joined to generally U-shaped clamping members including sidewalls 76 which are trapezoidal in shape to conform substantially to the shape of the ends 77 of the frame forming the holder 71. To these side members 76 are connected reversely turned flanges 78 serving to hold the plate 74 to the holder 71 when the support plate is slid up over the frame between lowermost sheet in the stack and the next sheet to a position near the coating of adhesive on the lowermost sheet to clamp the lower sheet in place.

Figure 10:
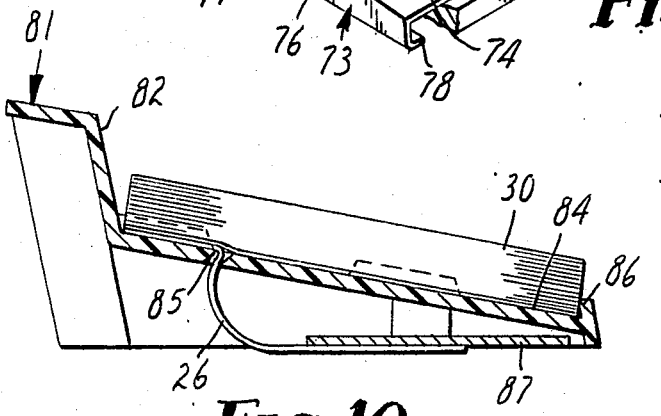
FIG. 10 is a vertical sectional view of a further embodiment of a holder according to the present invention.

FIG. 10 shows a further embodiment which comprises a holder for notepaper which is a unitary member without detachable pieces or pivotally joined pieces. In FIG. 10 the dispenser 81 comprises a frame 82 which may be molded of a suitable material and provided with a support surface 84 for supporting the stack 30 of notepaper. In this embodiment the lowermost sheet 26 is held tightly, to the support surface 84 by the sheet being bent and directed sharply back upon itself and then reversely directed again to bind the sheet in a narrow slot 85 defined by generally parallel wall members formed in the support plate 84 at an acute angle to support plate 84 which thus clamps the sheet 26 against vertical movement with respect to the support 84. An abutment 86 is formed at the front edge of the holder and of the support surface 84 to engage the lowermost sheets in the stack to restrict movement of the stack as the result of the lifting and peeling forces applied to remove a sheet from the stack of sheets 30.

To place the stack of sheets on the holder 81, the lowermost sheet is peeled from the forward edge of the pad and then directed through the slot 85 and drawn forward again to pull the pad down onto the upper edge of the support surface 84. The frictional forces applied against the opposite edges of the bent or folded sheet restricts its movement on the support surface 84.

In each embodiment the clamping action applied to the lowermost sheet extends to a position adjacent the adhesive bonded edge of the stack. The edge of the clamping member is thus one-fourth of an inch to one inch from the edge of the stack opposite the abutment, when on the support surface.

Having thus defined the present invention with reference to a preferred embodiment and several other embodiments, it is to be understood that other embodiments may be formed which do not depart from the spirit of the invention or the scope of the invention as claimed in the appended claims.

I claim:

1. A dispenser for a stack of sheet material comprising sheets joined in the stack by a narrow band of pressure-sensitive adhesive on one side of each sheet adjacent one end and affording dispensing of single sheets from the stack and separation of the adhesive coated end of the single sheet from the remaining sheets in the stack, said dispenser comprising:

a support member having a generally planar support surface for supporting the stack of sheet material, clamping means cooperating with said support surface for engaging the lowermost sheet of said stack between said adhesive coated end and the other end opposite aid coated end, and fixing said sheet in relationship to the support, and abutment means projecting above the plane of the support surface for engaging said other end of said stack for cooperating with said clamping means for restricting movement of said stack in relationship to the support surface during separation of the top sheet from a said stack, wherein said clamping means cooperating with said support surface comprises a clamping plate adapted to be positioned over a lowermost sheet in a said stack and said clamping plate is formed with a clamp member comprising a flange connected to the forward edge of the clamping plate and extending transversely of the support member and a second plate member positioned beneath the support member which is normally spaced from the clamping plate by a distance less than the thickness of the support member to urge the clamping plate toward the support surface to frictionally fix said lowermost sheet onto said support surface.

2. A dispenser for a stack of sheet material comprising sheets joined in the stack by a narrow band of pressure-sensitive adhesive on one side of each sheet adjacent one end and affording dispensing of single sheets from the stack and separation of the adhesive coated end of the single sheet from the remaining sheets in the stack, said dispenser comprising:

a support member having a generally planar support surface for supporting the stack of sheet material, clamping means cooperating with said support surface for engaging the lowermost sheet of said stack between said adhesive coated end and the other end opposite said coated end, and fixing said sheet in relationship to the support, and abutment means projecting above the plane of the support surface for engaging said other end of said stack for cooperating with said clamping means for restricting movement of said stack in relationship to the support surface during separation of the top sheet from a said stack, wherein said clamping means cooperating with said support surface comprises a plate extending transversely of the support member, said plate having clamp members at the ends thereof which cooperate with the ends of the support member to frictionally engage the ends of said support member adjacent the edges of said support surface for holding the plate and the bottom sheet of a said stack against movement in the plane of the support surface, said plate having said abutment means affixed thereto to engage the sheets along the front edge of the support member.

3. A dispenser for a stack of sheet material comprising sheets joined in the stack by a narrow band of pressure-sensitive adhesive on one side of each sheet adjacent one edge of the stack and affording dispensing of single sheets from the stack and separation of the adhesive coated end of the single sheet from the remaining sheets in the stack, said dispenser comprising:

a support member having a generally planar support surface for supporting said one edge of the stack of sheet material, a plate member positioned on said support member and movable with respect to said support member, means affording limited movement of said plate member with respect to said support member for inserting the adhesive-free portion of the lowermost sheet in a said stack between said plate member and said support member, an abutment member formed along an edge of said plate member and projecting from the surface of said plate member supporting said stack to engage the edge of the stack of sheets opposite said one edge and projection means projecting from the opposite surface of said plate member for penetrating a said lowermost sheet in a said stack, said projection means being positioned on said plate member to penetrate a said sheet when said edge of said stack opposite said one edge is contacting said abutment.

4. A dispenser according to claim 3 wherein said means affording limited movement of said plate member comprises means for pivoting the edge of the plate member adjacent said abutment member.

* * * * *